US006277802B1

(12) United States Patent
Chiou et al.

(10) Patent No.: US 6,277,802 B1
(45) Date of Patent: Aug. 21, 2001

(54) USE OF CATIONIC NITRILES IN COMBINATION WITH ENZYMES IN MACHINE DISHWASHING DETERGENT APPLICATIONS

(75) Inventors: Catherine Chiou, Saddle Brook; Narish Dhirajlal Ghatlia, Rutherford, both of NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/535,643

(22) Filed: Mar. 24, 2000

(51) Int. Cl.[7] ..... C11D 3/395; C11D 1/62; C11D 3/386

(52) U.S. Cl. ..... 510/220; 510/226; 510/302; 510/312; 510/314; 510/320; 510/367; 510/372; 510/375; 510/392; 510/514; 510/530

(58) Field of Search ..... 510/220, 226, 510/302, 312, 314, 320, 367, 372, 375, 392, 530, 514

(56) References Cited

U.S. PATENT DOCUMENTS 5,888,419 * 3/1999 Casella et al. ..... 252/186.39

* cited by examiner

*Primary Examiner*—Yogendra Gupta
*Assistant Examiner*—Charles Boyer

(57) ABSTRACT

Detergent formulations containing cationic nitriles are shown to exhibit enhanced stain removal, enhanced starchy soil removal and enhanced enzyme stability as compared to similar formulations containing TAED.

16 Claims, 3 Drawing Sheets

USE OF CATIONIC NITRILES IN COMBINATION WITH ENZYMES IN MACHINE DISHWASHING DETERGENT APPLICATIONS

FIELD OF THE DISCLOSURE

The present disclosure relates to detergent compositions that contain both bleaching compounds and enzymes.

BACKGROUND

It is well known that enzymes are useful for enhancing the soil/stain removal properties in detergent compositions. Enzymes provide a well-documented benefit in both laundry and machine dishwashing detergent performance, particularly for removing starch and protein soils.

Bleaching compositions and bleach systems are also well known and provide desired cleaning properties in many commercial detergents. Chlorine and N,N,N',N'-tetraacetyl ethylene diamine (TAED)/perborate, for example, are well known for their bleaching properties. Bleaching systems that include cationic nitrites in the presence of peroxide are also known (see, for example, U.S. Pat. Nos. 5,236,616 and 5,281,361, EP 0 303 520 B1 and WO 99/63038, the contents of which are incorporated herein by reference).

Unfortunately, bleaches and bleaching systems are generally known to have detrimental effects on enzymes. Without being bound by theory, it is believed that bleaches can decrease enzyme activity through direct oxidation or denaturization of the enzymes.

Therefore, there is a need for detergent compositions that have both enzymes and bleaching compositions/systems that can coexist with minimal detrimental effects on enzyme activity. There is also a need for more cost-efficient detergent formulations, wherein the desired benefits are achieved through decreased quantities of raw material, through the use of less expensive ingredients and/or more efficient compatibility of materials.

SUMMARY

The present disclosure relates to the unexpected finding that enzymes, particularly amylase, exhibit better stability when cationic nitriles are used as a bleach activator (or precursor) as compared to other bleaching systems, such as TAED/perborate. As a consequence of this finding, enzyme levels can be reduced in detergent formulations without sacrificing soil removal performance or performance for a given enzyme dose can be enhanced.

DETAILED DESCRIPTION

Figure 1:
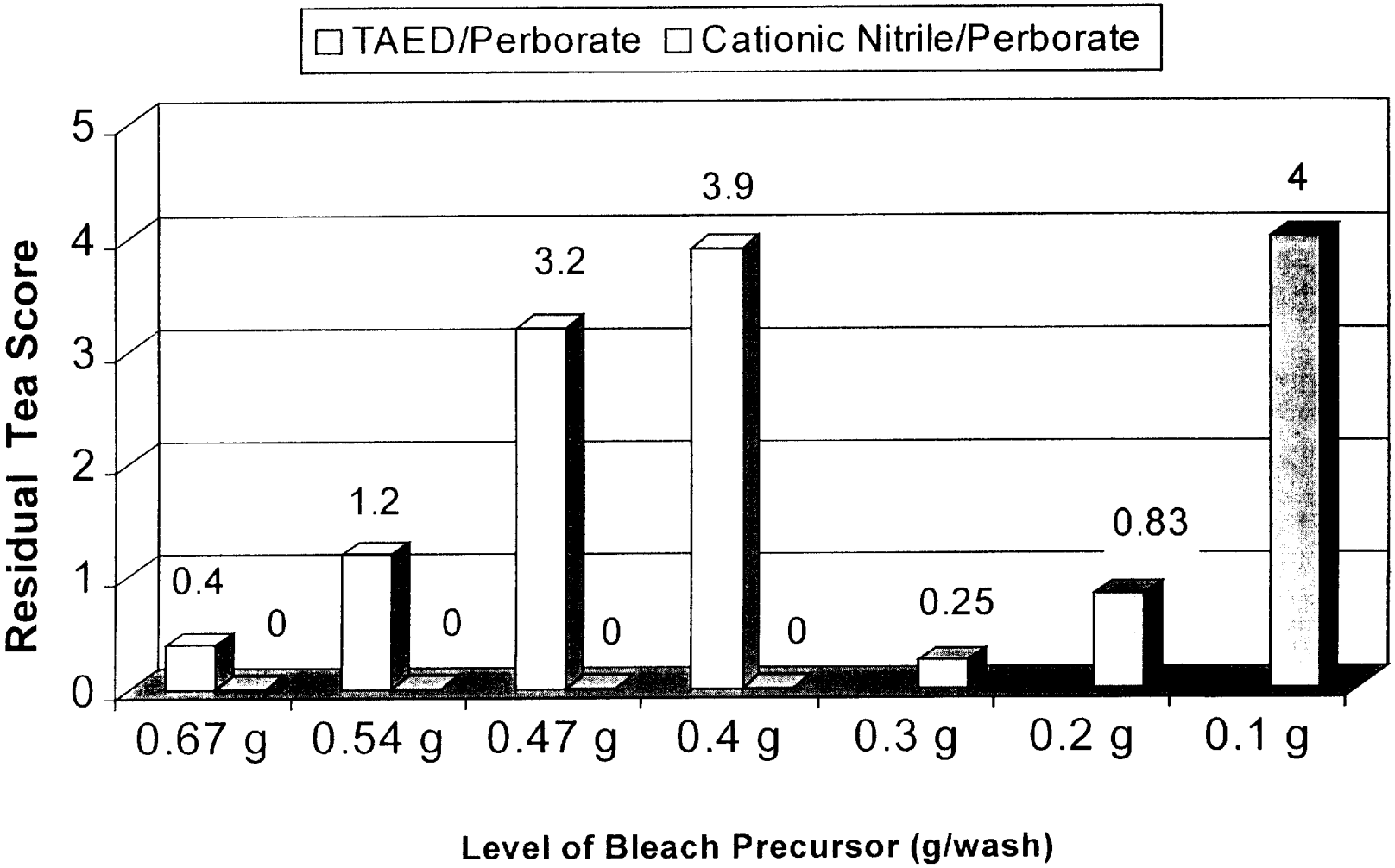
FIG. 1 illustrates the effect of bleach precursors on tea stain removal.

The present disclosure primarily relates to detergent formulations that are suitable for use in machine dishwashers. However, it is believed that teachings disclosed herein are relevant and applicable to other detergent compositions wherein bleaches and enzymes are present, such as in laundry detergent formulations. The formulations disclosed herein can be powder, tablet, block, gel, liquid, solid or semi-solid.

Suitable formulations generally include one or more of the following ingredients: both phosphate and nonphosphate (e.g. sodium citrate) builders; pH buffering agents; silicates; bleaches and bleaching systems including bleach catalysts; surfactants; enzymes; enzyme stabilization systems; thickeners; stabilizers and/or co-structures; fillers; defoamers; soil suspending agents; anti-redeposition agents; anti-corrosion agents; ingredients to enhance decor care; anti-tarnish agents; rinse aids; colorants; perfumes; and other known functional additives. More specific examples of the above and other known machine dish detergent ingredients are disclosed, for example, in U.S. Pat. Nos. 5,695,575, 5,705,465, 5,902,781, 5,904,161 and 6,020,294, the contents of which are incorporated herein by reference.

In general, formulations in accordance with the present disclosure contain two essential components: enzymes and cationic nitriles. The examples, below, show the economic and cleaning benefits of such formulations as compared to other known enzyme/bleach compositions.

Suitable phosphate and non-phosphate formulations in accordance with the present disclosure include the following:

TABLE A

Formulation Ranges

| Component | Wt % |
|---|---|
| Sodium Carbonate | 0–50 |
| Sodium Bicarbonate | 0–30 |
| Sodium Disilicate | 0–40 |
| Sodium Citrate | 0–70 |
| Sodium Tripolyphospahte | 0–70 |
| Sodium Perborate or percarbonate | 2–25 |
| Bleach Activator/Catalyst | 0.05–5 |
| Anti-tarnishing agent | 0–2 |
| Polymer | 0–10 |
| Anti-scalant | 0–5 |
| Amylase | 0–10 |
| Protease | 0–5 |
| Nonionic Surfactant | 0–5 |
| Perfume | 0–0.5 |
| Sodium Sulfate | Balance |

In all examples, the following base formulation (no bleach precursor) was used:

TABLE B

Base Formulation

| Component | Wt % |
|---|---|
| Sodium Carbonate | 18.6 |
| Sodium Disilicate | 9.5 |
| Sodium Citrate | 17.3 |
| Sodium Perborate | 6.5 |
| Anti-tarnishing agent | 0.05 |
| Polymer | 2.6 |
| Anti-scalant | 0.7 |
| Amylase | 1.1 |
| Protease | 1.8 |
| Sodium Sulfate | Balance |

Suitable cationic nitrites include those disclosed in EP 0 303 520 B1. The preferred cationic nitrile, and that which was used in the examples is of the following formula:

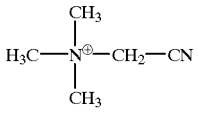

The preferred anion is $CH_3OSO_3^-$, however any suitable anion can be used.

More generally, suitable cationic nitrile compounds include the following:

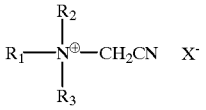

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and optionally additional heteroatoms, and $X^-$ is a suitable anion.

Roux Blanc Soil

In the examples and claims that refer to Roux Blanc soil, the soil was prepared as follows:

1. 1.4 L of water was heated to 85° C. in a 2 L jacketed beaker while stirring with a mechanical stirrer (speed set at 200 rpm).
2. Roux Blanc neutral base (available from Nestle Belgilux, S. A., Belgium) and potato starch (ex. Sigma Chemical Company) were mixed at a 5:1 ratio using a mixer.
3. 100 g of this Roux Blanc-potato starch mix was added to the hot water in the jacketed beaker while stirring continued.
4. The mixture was heated and stirred in the jacketed beaker at 85° C. for 30 minutes.
5. The resulting roux soil mix was evenly sprayed on clean ceramic plates (each 7 inches in diameter) giving roughly 2 g of soil per plate.
6. After being air-dried, the plates were baked at 235° F. (113° C.) for 1 hour, and cooled to room temperature overnight prior to be used in dishwashing machine tests.

Azure Starch Soil

In the examples that refer to Azure Starch soil, the soil was prepared as follows:

A first vessel was charged with 500 mL of water and 50 g of commercially available crystalline potato starch. The contents were stirred at ambient temperature to produce a potato starch suspension. A second vessel was charged with 5 grams of Remazol brilliant blue dye (commercially available from Aldrich) and 500 mL of water. The contents were stirred at ambient temperature to produce a dye solution. The dye solution was added to the potato starch suspension to produce a starch-dye solution which was subsequently stirred and heated to 50° C. The starch-dye solution was maintained at 50° C. for about 45 minutes, during which 100 grams of sodium sulfate were added in parts (about 4 additions). To the resulting mixture, a solution having 50 mL of water and 5 grams of tri-basic sodium phosphate was added wherein the resulting final mixture was stirred for 75 minutes while maintaining the temperature at 50° C. After stirring, the final mixture was filtered and the filtrate was discarded. The resulting solid was resuspended in water and refiltered. The washing was repeated until the filtrate obtained was colorless. The resulting final solid was washed with methanol to remove any residual water. The resulting washed final solid was about 50 grams of Azure Starch as described in this disclosure (crystalline potato starch with dye covalently bonded to its backbone and having a maximal absorbance at 596 nm). This experiment was performed in a manner very similar to the one described in *New Method for the Determination of Alpha-Amylase,* Experimentia 23:805, H. Rimperknecht, P. Wilding, and J. Berk (1967).

Glass slides (5 cm×5 cm) were washed, dried and weighed. A vessel was charged with 120 mL of water which was preheated to 80° C. and 2.0 grams of Azure Starch as prepared above. The resulting mixture was stirred and maintained at 80° C. for about 15 minutes, after which the resulting product was a thick gel. The Azure Starch was applied in 5 mL portions, onto one side of the glass slides with a pipette. The coated slides were dried overnight at ambient temperature, resulting in slide having dry retrograded Azure Starch on one side amounting to about 80–85 milligrams of substance.

EXAMPLE 1: Tea Stain Removal

Several dishwashing machine tests were carried out and results show that cationic nitriles are a more effective bleach precursor than TAED in terms of tea stain removal. In these tests, 30 g of base formulation (Table B) was used in each machine test. Bleach precursor (TAED or cationic nitrile) was then dosed separately at different levels to test the effectiveness of tea stain bleaching.

Machine test conditions were as follows: a Bauknecht GSF 4741 dishwasher set at the 50 Normal program. Water hardness was adjusted to 300 ppm of total hardness ($Ca^{+2}$:$Mg^{+2}$=4:1, expressed as $CaCO_3$) and 320 ppm of temporary hardness expressed as sodium bicarbonate (300/320 ppm water hardness). Soil load includes 40 g of ASTM standard food soil (a 4:1 wt/wt ratio of margarine/powdered milk) spread on the dishwasher door, 6 tea stained cups, 4 drinking glasses, 4 lipstick stained drinking glasses, 4 ceramic and 4 stainless steel plates with baked-on egg yolk soil, 4 wheat soiled, 4 custard soiled and 4 Roux Blanc soiled ceramic plates. Residual scores for tea stain are a 0 to 5 scale and 0 being completely cleaned.

As can be seen from Table 1 (below) and FIG. 1, cationic nitriles can be dosed at a reduced level of TAED (e.g. 1.0% of cationic nitriles vs 2.23% of TAED) to give an equal performance on tea stain removal.

TABLE 1

| Tea Stain Removal | | | |
|---|---|---|---|
| Bleach Precursor | Wt (g) | Wt %[a] | Residual tea score (0 to 5) |
| TAED | 0.67 | 2.23 | 0.4 |
| | 0.54 | 1.80 | 1.2 |
| | 0.47 | 1.57 | 3.2 |
| | 0.40 | 1.33 | 3.9 |

TABLE 1-continued

| Tea Stain Removal | | | |
|---|---|---|---|
| Bleach Precursor | Wt (g) | Wt %[a] | Residual tea score (0 to 5) |
| Cationic Nitrile | 0.67 | 2.23 | 0 |
| | 0.54 | 1.80 | 0 |
| | 0.47 | 1.57 | 0 |
| | 0.40 | 1.33 | 0 |
| | 0.30 | 1.00 | 0.25 |
| | 0.20 | 0.67 | 0.83 |
| | 0.10 | 0.33 | 4.0 |

[a]wt % indicates weight percentage of bleach precursor in the detergent composition.

EXAMPLE 2: Effect on Starchy Soil Removal

An unexpected benefit on starchy soil removal is noticed with use of cationic nitrites as bleach precursors. This benefit is most noticeable on composite soil, such as Roux Blanc, containing greater than 50% starch in addition to fat and protein, and on potato starch soil. Machine test results of both cationic nitrile and TAED bleaching systems on starchy soil, such as roux blanc, potato, wheat and custard, are recorded in Table 2 and FIG. 2. Scores on tea stain removal are also listed for comparison. In these tests, 24 g of base formulation (Table B) was used as the detergent. Cationic nitrile was dosed at either the same level of TAED (0.54 g/wash) or at a half of that amount (0.27 g/wash). Machine test conditions were identical to Example 1. Residual soil/stain score were recorded in a 0-to-100 scale, 0 being completely cleaned.

TABLE 2

| Effect on Starchy Soil Removal | | | | | | |
|---|---|---|---|---|---|---|
| | | % Residual Soil/Stain[b] | | | | |
| Bleach Precursor | Wt %[a] | Roux Blanc | Potato | Wheat | Custard | Tea |
| Cationic Nitrile | 1.12 | 3 | 6 | 0 | 1 | 13 |
| Cationic Nitrile | 2.24 | 3 | 7 | 1 | 3 | 0 |
| TAED | 2.24 | 28 | 15 | 3 | 5 | 24 |

[a]Wt % indicates weight percentage of bleach precursor in the detergent composition.
[b]% Residual soil/stain is determined based on area covered by soil/stain and intensity of soil/stain remained on dishware after being cleaned, and is expressed as a 0 to 100 scale, 0 being completely cleaned.

Figure 2:
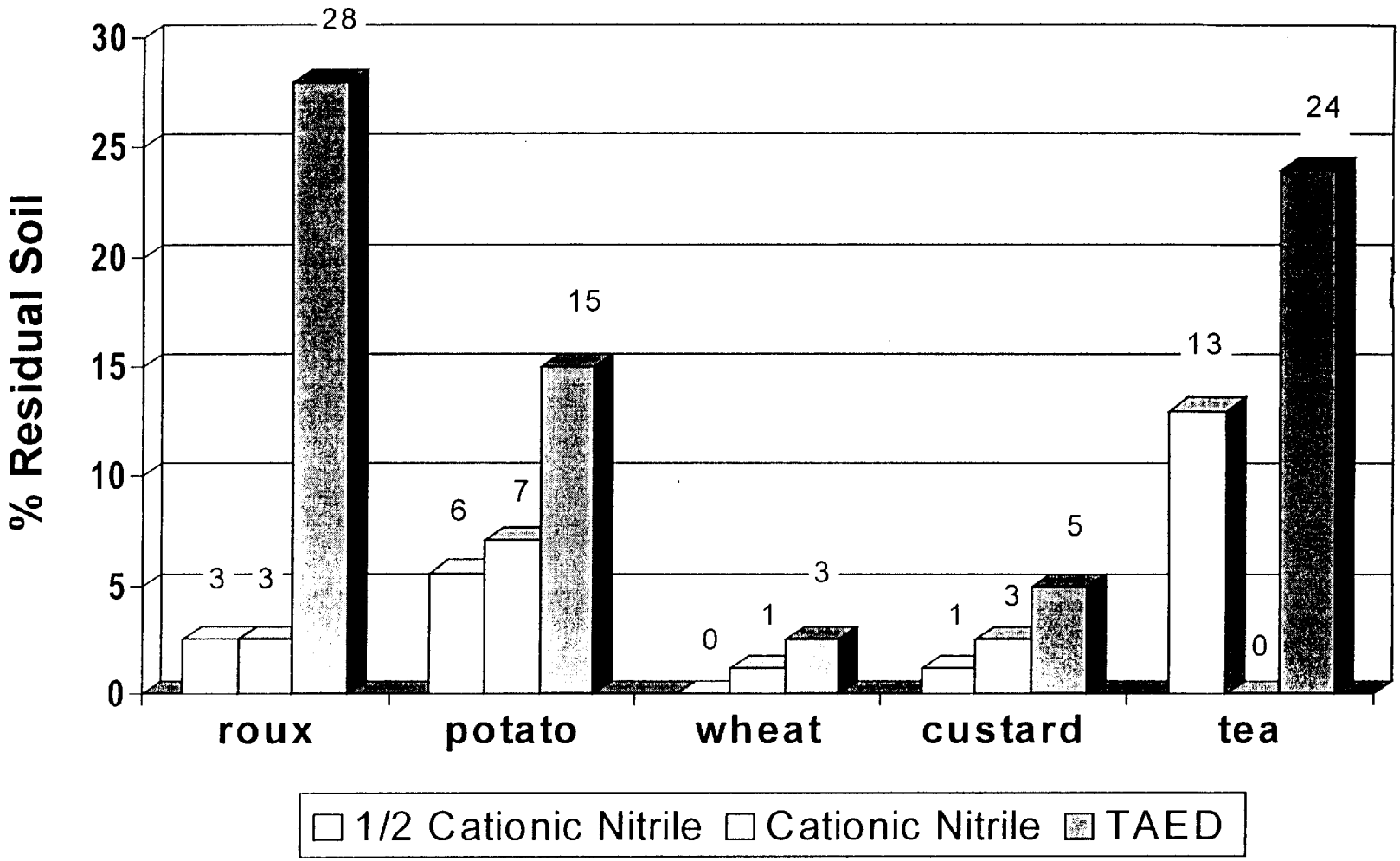
FIG. 2 illustrates the extent of starchy soil removal as well as tea stain removal in the presence of different bleach precursors.

With reference to Table 2 and FIG. 2, cationic nitriles are clearly more effective in tea stain removal than TAED. While wheat and custard soiled plates are almost completely cleaned for both systems, scores on residual roux and potato soil indicate the benefit of using cationic nitrites over TAED as the bleach precursor. This benefit is realized even when cationic nitrites are present at one half the weight percent level as TAED.

EXAMPLE 3: Effect on Enzyme Stability

To confirm the soil removal benefits observed in dishwashing machine tests, several model beaker experiments were carried out to monitor effect of bleach precursors on enzyme stability and soil removal on soil monitors.

Figure 3:
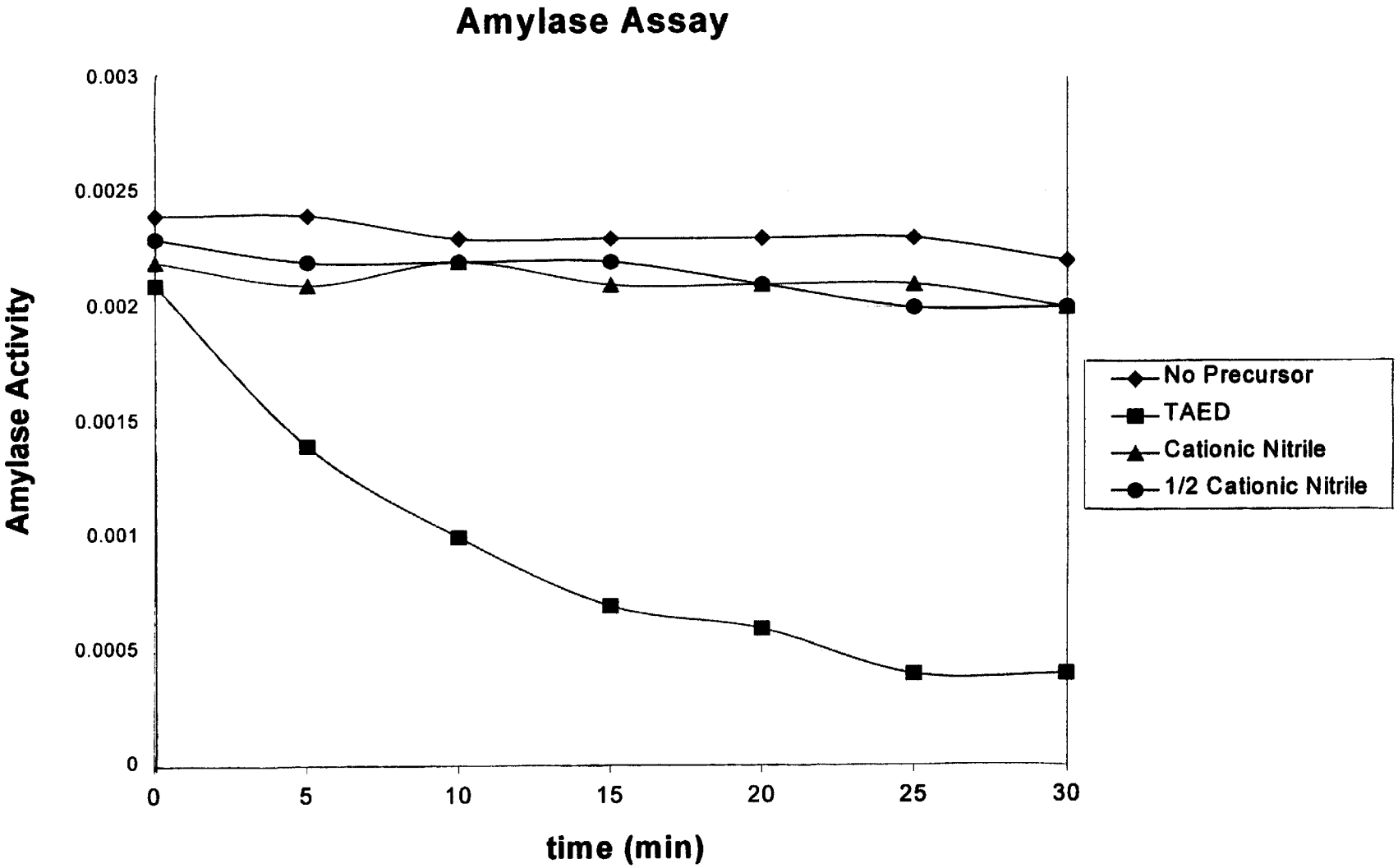
FIG. 3 illustrates the effect of bleach precursors on amylase enzyme stability.

Four beakers containing 6 g/L of base formulation (Table B, excluding enzymes) and water containing 150 ppm hardness ($Ca^{+2}$:$Mg^{+2}$=4:1) were placed in a temperature and stirring speed-controlled multi-stirrer and heated to 55 ° C. Three glass slides (5 cm×5 cm) soiled with standard Roux Blanc soil (about 100 mg per slide) were placed in each beaker to provide a quantitative monitor of 'in-wash' performance. Termamyl 60T (amylase) and Savinase 6.0T (protease) were dosed in each beaker (levels as indicated in Table B). Different levels of bleach precursor were then introduced. Aliquots were taken every five minutes over the course of 30 minutes, and residual enzyme concentrations determined by Cobas assay. Residual roux soil on glass slides was determined after the glass slides were air-dried overnight Results on enzyme stability are shown in Table 3 and FIG. 3. Roux soil removal, determined by weight loss of glass slides, is also shown in Table 3.

TABLE 3

| Effect on Enzyme Stability and Roux Soil Removal | | | |
|---|---|---|---|
| Bleach Precursor | Wt %[a] | % Residual Amylase[b] | % Residual Roux Soil[c] |
| Control (no precursor) | — | 91.7 | 25.4 |
| Cationic Nitrile | 1.12 | 83.3 | 20.3 |
| Cationic Nitrile | 2.24 | 83.3 | 23.3 |
| TAED | 2.24 | 16.7 | 34.0 |

[a]Wt % indicates weight percentage of bleach precursor in the detergent composition.
[b]% Residual amylase is determined by Cobas assay after 30 min wash at 55° C.
[c]% Residual roux soil is determined by weight loss of roux soiled glass slides.

It is apparent that a TAED/perborate system causes a detrimental effect on amylase stability, while a cationic nitrile/perborate system contributes little to no effect on amylase stability. Results on roux soil removal from glass slides are also consistent with the amylase stability profile. The TAED/perborate system results in the most residual roux soil remained on glass slides, while cationic nitrile dosed at both equal and a half levels of TAED gives roux soil removal benefit similar to that of the control run (no precursor added).

EXAMPLE 4: Effect on Starch Degradation

It is demonstrated in the previous section that TAED/perborate causes a detrimental effect on amylase stability under wash conditions in comparison with cationic nitrile/perborate system. To verify this finding, the effect of bleach precursor on amylolytic activity by monitoring Azure Starch (defined, supra) degradation was investigated.

Model beaker tests were carried out using retrograded Azure Starch slides as soil monitors. Wash solutions containing 150-ppm hardness ($Ca^{+2}$:$Mg^{+2}$=4:1) was placed in a jacketed beaker connected to a water circulating bath to maintain a constant temperature. Base formulation (Table B, excluding enzymes) was added to the wash solution (dosed at 6 g/L) and the solution was stirred until constant temperature is reached (55° C.). Three retrograded Azure Starch slides were placed in the beaker, followed by the addition of bleach precursor. The amylase (Termamyl 300L) was then dosed to provide a concentration of 40 ppm in the wash liquor. The degradation of starch was monitored by spectrophotometric analysis of the wash liquor at 30 sec intervals over a period of 30 min. As the Azure Starch is degraded, soluble fragments containing dye will be liberated, resulting in formation of blue color in the solution. Absorbance was measured at 596 nm to monitor system activity on starch degradation.

As illustrated in Table 4 (below), the effectiveness of Azure Starch degradation at the end of a 30-min wash can be calculated by comparison to the control run (no bleach precursor added).

TABLE 4

Effect on Azure Starch Degradation

| Bleach Precursor | Wt %[a] | Absorbance at 596 nm | % Loss of Azure Starch Degradation Efficiency against Control[b] | % Residual Azure Starch Remained on Glass Slides[c] |
|---|---|---|---|---|
| Control (no precursor) | — | 0.2357 | — | 47.5 |
| Cationic Nitrile | 1.12 | 0.2091 | 11.3 | 57.0 |
| Cationic Nitrile | 2.24 | 0.1674 | 29.0 | 71.0 |
| TAED | 2.24 | 0.1523 | 35.4 | 73.2 |

[a]Wt % indicates weight percentage of bleach precursor in the detergent composition.
[b]% Loss of Azure Starch degradation efficiency against control is calculated as $(1 - A_B/A_1) \times 100\%$, where $A_B$ is the absorbance at 596 nm in the presence of bleach precursor and $A_1$ is the absorbance at 596 nm without the presence of bleach precursor (Control).
[c]% Residual Azure Starch remained on glass slides is determined by weight loss of Azure Starch soiled glass slides.

Clearly cationic nitrites, particularly at reduced levels, have a less detrimental effect on amylase stability and activity.

All component percentages are based on weight, unless otherwise indicated. All numerical values are considered to be modified by the term "about" and should be given the broadest available range of equivalents when construing the claims.

Although the illustrative embodiments of the present disclosure have been described herein with reference to the accompanying figures, it is to be understood that the disclosure not limited to those precise embodiments, and that various other changes and modifications may be affected therein by one skilled in the art without departing from the scope or spirit of the disclosure. For example, while the disclosed examples primarily relate to dishwashing applications, use of cationic nitriles to enhance enzyme stability and/or activity can also be useful in laundry applications.

What is claimed is:

1. A detergent composition comprising:

a) from about 0.05 wt% to about 5 wt% of a cationic nitrile compound;

b) an effective amount of a peroxygen source; and c) from about 0.1 wt% to about 10 wt% of amylase;

wherein said composition provides starchy soil removal performance that is better than the performance of an otherwise identical formulation that has no cationic nitrile compound and about an equal weight percent of TAED.

2. A detergent composition according to claim 1, wherein said cationic nitrile has the following formula

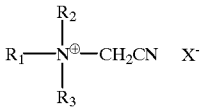

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and $X^-$ is a suitable anion.

3. A detergent composition according to claim 2, wherein $R_1$, $R_2$, and $R_3$ are each $CH_3$.

4. A detergent composition according to claim 2, wherein $X^-$ is $CH_3OSO_3^-$.

5. A detergent composition according to claim 1, wherein the starchy soil is Roux Blanc soil.

6. A detergent composition comprising:

a) from about 0.05 wt% to about 5 wt% of a cationic nitrile compound;

b) an effective amount of a peroxygen source; and c) from about 0.1 wt% to about 10 wt% of amylase;

wherein said composition provides both starchy soil removal and tea stain removal performance that is better than the performance of an otherwise identical formulation that has no cationic nitrile compound and about an equal weight percent of TAED.

7. A detergent composition according to claim 6, wherein said cationic nitrile has the following formula

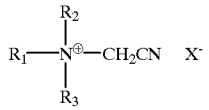

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and $X^-$ is a suitable anion.

8. A detergent composition according to claim 7, wherein $R_1$, $R_2$, and $R_3$ are each $CH_3$.

9. A detergent composition according to claim 7, wherein $X^-$ is $CH_3OSO_3^-$.

10. A detergent composition according to claim 6, wherein the starchy soil is Roux Blanc soil.

11. A detergent composition according to claims 1–10, further comprising a detergency builder.

12. A detergent composition according to claim 11, wherein the composition is a powder, tablet, block, gel, liquid, solid or semisolid.

13. A method of enhancing the activity of amylase in wash liquor comprising water, a detergent formulation and a peroxide activator, the method comprising:

a) providing amylase;

b) providing a bleaching system consisting essentially of a peroxygen source and cationic nitrile compounds;

c) disposing a) and b) in water to create said wash liquor.

14. The method according to claim 13, wherein said cationic nitrile has the following formula:

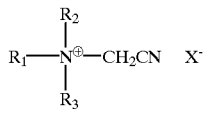

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and $X^-$ is a suitable anion.

15. The method according to claim 14, wherein $R_1$, $R_2$, and $R_3$ are each $CH_3$.

16. The method according to claim 14, wherein $X^-$ is $CH_3OSO_3^-$.

* * * * *